United States Patent [19]

Husband

[11] 4,390,103

[45] Jun. 28, 1983

[54] SHELVING SYSTEM

[75] Inventor: Wallace T. Husband, West Vancouver, Canada

[73] Assignee: E-Z-Rect Metal Products Ltd., North Vancouver, Canada

[21] Appl. No.: 228,173

[22] Filed: Jan. 23, 1981

[51] Int. Cl.[3] ..... A47F 5/14

[52] U.S. Cl. ..... 211/182; 403/274

[58] Field of Search ..... 211/208, 182, 189, 191, 211/187; 108/80; 403/347, 274, 384; 52/637, 638, 735

[56] References Cited

U.S. PATENT DOCUMENTS

| | | | |
|---|---|---|---|
| 895,578 | 8/1908 | McNamara . | |
| 1,634,128 | 6/1927 | Small | 108/80 |
| 1,795,060 | 7/1929 | Vance . | |
| 1,808,082 | 6/1931 | Thompson | 52/637 |
| 2,279,325 | 4/1942 | Kaldizar . | |
| 2,530,632 | 11/1950 | Scherstuhl . | |
| 2,712,200 | 7/1955 | Dearling | 403/347 X |
| 2,972,506 | 2/1961 | Haag | 108/64 |
| 3,050,160 | 8/1962 | Chesser | 403/274 |
| 3,193,060 | 7/1965 | Park | 211/182 X |
| 3,490,604 | 1/1970 | Klein | 211/191 |
| 3,604,176 | 9/1971 | Campbell | 52/735 |
| 4,063,835 | 12/1977 | Husband et al. . | |
| 4,129,279 | 12/1978 | Burkholder | 211/182 X |

*Primary Examiner*—Francis K. Zugel
*Assistant Examiner*—Peter A. Aschenbrenner
*Attorney, Agent, or Firm*—Christensen, O'Connor, Johnson & Kindness

[57] ABSTRACT

A shelving system (10) includes diagonal braces (46) which extend between posts (12) and cross members (36) which transversely interconnect the posts (12). The lower end portion (50) of brace (46) is formed in the shape of a hook to extend through a slot (18) and engage with post face wall (20). Brace (46) also includes an elongate, planer intermediate portion (48) and an upper end portion (58) extending transversely to intermediate portion (48) to extend through a diagonal slot (56) formed in cross member (36). Brace upper end portion (54) includes a transverse tab (60) which can be bent over once end portion (54) is inserted through slot (56) to thereby securely lock brace (46) engaged with cross member (36).

5 Claims, 5 Drawing Figures

12
14
16
18
20
26
28
30
32
36
38
40
42
44
46
48
50
52
54
56
58
60
61
62
64

SHELVING SYSTEM

DESCRIPTION

1. Technical Field

The present invention relates to frame constructions and more particularly to a unique brace for reinforcing a shelving system.

Shelves for storing goods in warehouses, workshops, retail stores and even homes are commonly constructed from prefabricated, standardized components which can be compactly shipped from a factory and then assembled on site. The shelves may be assembled in a variety of sizes and configurations without requiring any special skills or tools. Typically, shelving systems comprise a number of vertical and horizontal elements bolted or otherwise connected by fasteners. In a shelving system manufactured by E-Z-Rect Metal Products, the assignee of this invention, pairs of tall, transversely spaced posts are interconnected by horizontally disposed cross members having hooks formed at each end for engagement within slots formed along the height of the posts. The pairs of posts are interconnected by horizontally disposed, longitudinally extending members also having hooks formed at their ends for engaging within slots formed in the sidewalls of the posts. The longitudinal members are overlaid by wooden panels or the like to form the shelves.

Because of the rapid increase in the cost of raw and semi-finished materials in recent years, applicant has sought to design a shelving system constructed from lightweight components of small cross-sectional size which require less material than components of past shelving systems. Applicant has found, however, that shelving constructed from lighter weight, reduced dimension, components is unsatisfactorily lower in lateral stability than shelving constructed from the traditional heavier weight, relatively large dimension components. Use of conventional bolted or welded bracing to overcome this instability would both make the unit more complicated to set up and break down and would require substantial additional costly materials and parts. The present invention provides a one piece diagonal brace of unique form which may be quickly and easily installed and which strengthens the shelving to at least the level of prior shelving formed from larger sized components.

2. Background Art

A diagonal lattice brace for use in a metal framework is disclosed in U.S. Pat. No. 1,795,060 wherein one end of the brace is riveted to the end of a cross member interconnecting two tubular uprights. The opposite end of the diagonal brace is slotted to form a hook which extends to an opening formed in the corresponding upright member to engage therewith. A drawback to this particular design is that the diagonal brace is riveted to the cross member which requires a time consuming procedure necessitating specialized equipment.

U.S. Pat. No. 2,297,325 discloses a gun rack utilizing a diagonal brace constructed similarly to the brace disclosed in the above discussed '060 patent. However, in the '325 patent one end of the brace is pinned to a vertical upright and the opposite hooked end engages with a cross pin fixed to a horizontal beam spanning between the two uprights.

U.S. Pat. No. 895,578 discloses a joint for interconnecting the lower end of a diagonally disposed awning support rod with a vertical guide rod. A circular stud shaft extends transversely horizontally outward from one side of a flattened tip connected to the lower end of the diagonal support rod. A lug projects transversely from the free end of the stud shaft to cooperatively form a key which may be inserted within a correspondingly shaped keyway formed on a slide adapted to slide up and down the vertical guide rod. This joint design enables the tip of the awning support rod to pivot relative to the vertical guide rod as the slide moves up and down the guide rod.

U.S. Pat. No. 4,063,835, formerly assigned to the assignee of this application and now dedicated to the public, discloses a shelving system comprised solely of vertical and horizontal members interconnected by a hook and slot system. The size of the components used in this system removes the need for additional bracing to provide lateral stability.

DISCLOSURE OF THE INVENTION

The present invention relates to a large capacity, high strength shelving system constructed from lightweight, small dimension components which can be quickly and conveniently assembled together to form shelves of various widths, lengths and heights. The shelving system includes pairs of transversely spaced apart tubular posts interconnected by cross members having hooked end portions which extend through slots formed in the posts to engage with the face walls of the posts. The pairs of posts are longitudinally interconnected by elongate members also having hooked end portions which engage within slots formed in the sidewalls of the posts. Lengths of wooden boards or flat metal sheeting are typically placed over the longitudinal members to form the shelves.

To increase structural rigidity of the shelving system, especially in a direction laterally of the length of the shelves, the present invention includes diagonal braces which interconnect the posts with the transverse cross members. Each of the braces includes a lower end portion formed in the shape of a hook which is extendable through a vertical slot formed in a face wall of the post at an elevation below the cross member to thereby engage with the upper edge portion of the slot. The brace also includes an elongate, flat intermediate portion which extends diagonally upwardly and outwardly from its connection point with the post to overlap a portion of the cross member. The brace further includes an upper end portion disposed transversely to the intermediate portion and extendable through a diagonal slot formed in the cross member. The brace upper end portion includes an integral, nominally coplanar locking tab which extends in a direction nominally parallel to the length of the slot formed in the cross member. Once the brace upper end portion has been inserted within the cross member slot, the locking tab can be bent upwardly or downwardly to thereby prevent withdrawal of the upper end member from the slot even if the shelving system is rocked or heavily loaded. The brace adds enough rigidity to enable the shelving system to safely and securely carry the same level of loads supportable by shelves constructed from conventional, larger dimensioned components. Moreover, the shelving system of the present invention, including the diagonal brace, can be assembled without the use of any special skills or tools. A common pair of pliers can be used to bend the tab into locking position.

BRIEF DESCRIPTION OF THE DRAWINGS

The details of one typical embodiment of the present invention will be described in connection with the accompanying drawings, in which.

BEST MODE OF THE PRESENT INVENTION

Figure 1:
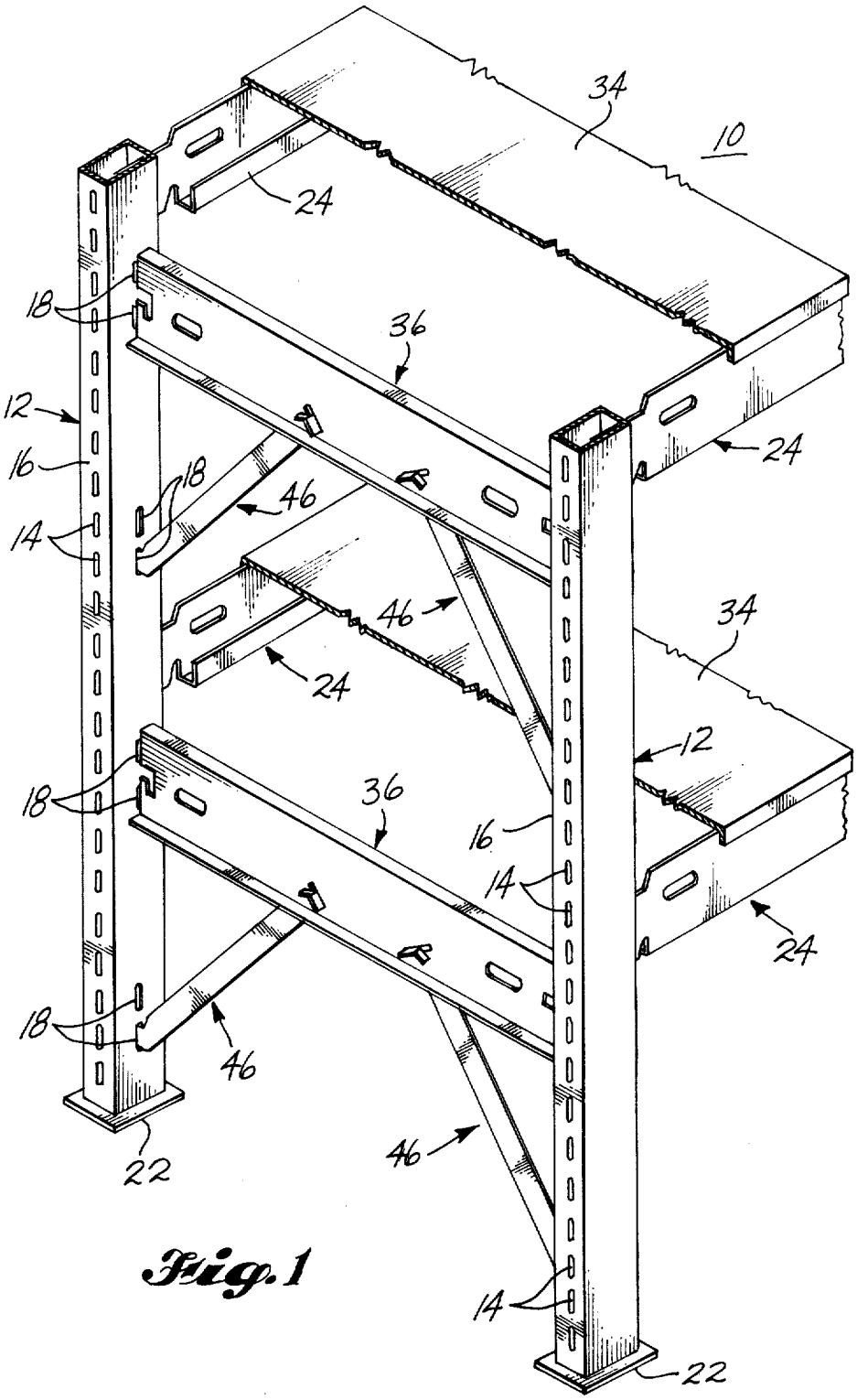
FIG. 1 is a fragmentary, isometric view of a shelving system constructed according to the present invention with portions broken away for clarity.

Referring initially to FIG. 1, the end portion of a typical shelving system 10 constructed according to the best mode of the present invention is illustrated as including a pair of rectangularly shaped, hollow, upright posts 12 spaced transversely apart from each other across the width of shelving system 10. Posts 12 include a series of aligned, vertically elongate, rectangularly-shaped slots 14 extending vertically along each sidewall 16 of posts 12. Also, pairs of aligned, vertically elongate, rectangularly-shaped slots 18 are vertically spaced apart along the inside face wall 20 of post 12. A circular foot member 22 is attached to the lower end of each post 12 to serve as a bearing pad for the post.

Although posts 12 are illustrated as being rectangular, they can be formed in other cross-sectional shapes such as square or circular. Preferably, posts 12 are formed from relatively light gauge steel material as compared to the material used to form posts of conventional shelving systems. Shelving system 10 further includes elongate members 24 which extend along the length of the shelving system to interconnect adjacent posts 12 which, while not shown, will be understood to be identical to the posts 12 shown.

Figures 2, 3, 4, 5:
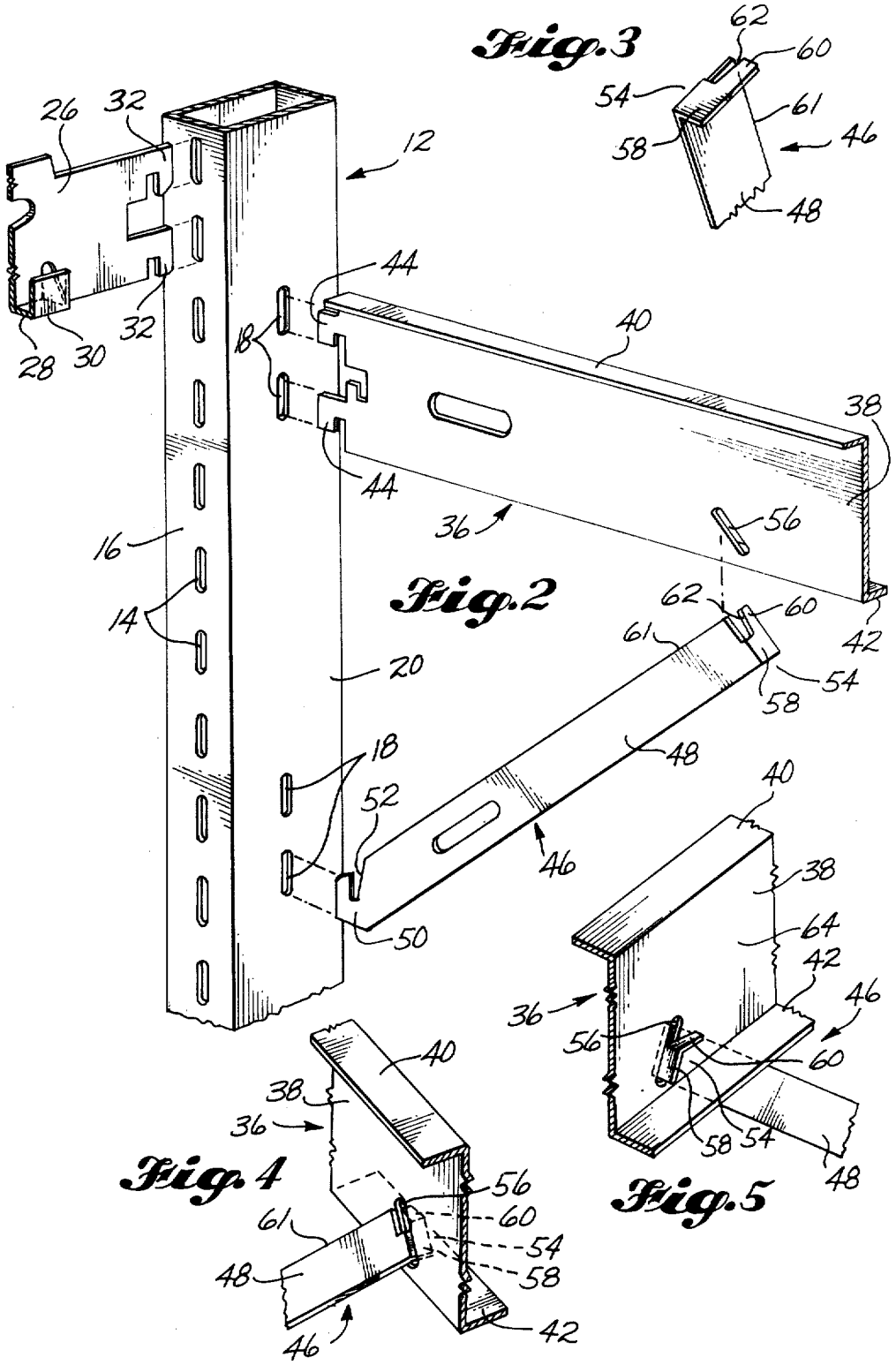
FIG. 2 is an enlarged, exploded, fragmentary, isometric view of the present invention specifically illustrating the manner in which the components of the shelving system are interconnected.
FIG. 3 is an enlarged fragmentary isometric view specifically illustrating the configuration of the brace upper end portion prior to the locking tab being deformed into locking position; and, FIGS. 4 and 5 are enlarged, fragmentary, isometric views of the present invention specifically illustrating the interconnection between the upper end portion of a brace and a cross member wherein the locking tab of the brace has been bent into locking position.

Referring also to FIG. 2, each member 24 as shown includes a relatively deep, vertically disposed outer flange 26, a relatively narrow web 28 extending transversely from the lower edge portion of flange 26 and a relatively shallow inner flange 30 extending upwardly from the edge portion of web 28 opposite flange 26 to lie in spaced, generally parallel, relationship to flange 26. It will be understood that the primary purpose of web 28 and flange 30 is to strengthen and give rigidity to the member 24 and thus other configurations, such as a simple V-shaped flange, could be used to accomplish the same purpose. A pair of vertically aligned and vertically spaced, downwardly open hooks 32 are formed at each end portion of longitudinal members 24. Hooks 32, which form an extension of flange 26 are of a width slightly narrower and of a depth slightly shorter than the width and length of side slots 14 of posts 12 and thus are slidably insertable within the side slots. Once disposed within slots 14, longitudinal member 24 can be pushed downwardly so that hooks 32 snugly engage with the portion of sidewall 16 immediately below the slots to thereby interconnect the longitudinal member with post 12.

As illustrated in FIG. 1, shelving system 10 also includes flat panels 34 which rest on top of outer flange 26 of longitudinal members 24 to serve as the shelf surfaces. Panels 34 include downwardly extending flanges which overlie outer flanges 26 of member 24. Panels 34 may be formed from lengths of wooden material, sheets of steel or other appropriate materials. Also, if desired, panels may be bolted, clipped or otherwise affixed to longitudinal members 24. In an alternative design panels, not shown, can be sized to rest on top of inner flanges 30 of longitudinal members 24 so that outer flanges 26 serve to constrain the panels from shifting.

Continuing to refer specifically to FIGS. 1 and 1, posts 12 are supported in transversely spaced apart parallel relationship to each other by cross members 36. As is clearly shown in FIG. 2, each cross member 36 is formed in a Z-shaped cross section having a relatively deep web 38 and relatively narrow upper and lower flanges 40 and 42, respectively, extending in opposite directions transversely from the web. A pair of vertically aligned, vertically spaces apart, downwardly open hooks 44 extend longitudinally outwardly from each end of web 38. Hooks 44 are sized to slidably extend through post face slots 18 and then downwardly engage with the portions of face wall 20 disposed below slots 18. Preferably, the above-described components of shelving system 10 are formed from relatively light gauge material in comparison to conventional shelving system components. However, constructing shelving system 10 in this manner significantly decreases the lateral stability of the shelving system, causing it to shift or sway when heavily loaded. To overcome this problem, shelving system 10 also includes elongate braces 46 which diagonally interconnect posts 12 with cross members 36. Each brace 46 includes a flat, relatively narrow, elongate intermediate portion 48 and a hooked lower end portion 50 forming an extension of the intermediate portion. Lower end portion 50 is disposed coplanar with intermediate portion 48 and defines a relatively narrow, groove 52 extending diagonally to the length of the brace. Groove 52 is open in the upward direction as shown in FIG. 2. Lower end portion 50 is sized to slidably extend within the lower slot of the pair of face slots 18 located next below the pair of face slots with which corresponding cross member 36 engages. Once brace lower end portion 50 is inserted laterally within slot 18, brace 26 can be lifted upwardly to lock groove 52 with the portion of face wall 20 extending above the slot.

While the sides of groove 52 are shown slanted upwardly slightly in FIG. 2, in another preferred embodiment the sides of slot 52 are vertical and the width of slot 52 between these sides is sized to be only slightly larger than the thickness of face wall 20. In this configuration, when the brace 46 is moved upwardly after the lower end portion 50 is inserted laterally into slot 18, the sides of the slot snugly engage face wall 20 thus preventing lateral movement of the brace with respect to face wall 20.

Brace 46 extends transversely outwardly and diagonally upwardly from post 12 to interconnect with cross member 36 at a location spaced from the end of the cross member. As best illustrated in FIGS. 4 and 5, the upper section of brace intermediate portion 48 partially overlaps cross member web 38. Brace 46 includes an upper end portion 54 which extends transversely to intermediate portion 48 to extend through an elongate, rectangularly shaped, diagonally disposed slot 56 formed within web 38 of cross member 36. For ease of manufacture, upper end portion 54 is preferably of the same width as intermediate portion 48 and is formed by bending over the end of brace 46.

Still referring specifically to FIGS. 2–5, brace upper end portion includes a base section 58 interconnected with and extending across approximately one half of the width of the base intermediate portion 48. The brace upper end portion also includes a tab 60 disposed nominally coplanar with, and extending outwardly from, base section 58. Tab 60 terminates at a tip 59 corresponding to the outward location of the side edge 61 of brace intermediate portion 48 so that the tab does not extend beyond the width of the brace intermediate portion. Tab 60, which is narrower than the length of base section 58 includes a side edge portion 62 spaced from base intermediate portion 48 to thereby define a narrow gap 63 therebetween. Gap 63 is not of uniform width, but is slightly narrower than the thickness of cross member web 38 at the intersection of tab 60 and base 58 and is slightly wider than the thickness of the cross member web at tab tip 59.

As illustrated in FIGS. 4 and 5, once upper end portion 54 of brace 46 is inserted within slot 56, the brace can be conveniently locked in place by bending over tab 60 relative to base section 58 by use of conventional tools, such as a hammer or a pair of pliers. Because the width of tab 60 is substantially narrower than the length of base 58, when tab 60 is struck, for instance with a hammer, the tab will bend at its intersection with base section 58 rather than causing the base section itself to deform. Also, because the width of gap 63 at the intersection of tab 60 and base 58 is slightly narrower than the thickness of cross member web 38, the cross member is tightly clamped between tab 60 and base 58 with tab edge 62 actually bearing against the adjacent face of the web.

It can be appreciated that when bent over into locking position, tab 60 prevents disengagement of brace 48 from cross member 36 even if the brace is highly loaded in tension due to the heavy loads carried by shelving system 20. Also, the overlapping of web 38 of cross member 36 by brace intermediate portion 48 and the pressing of tab side edge 62 against the adjacent surface 64 of web 38 prevents brace 46 from rotating about its longitudinal axis. As a consequence, brace 48 enhances the rigidity of shelving system 10 to the extent that even though the shelving system is constructed from lighter weight and smaller dimension components than previously usable in such shelving, it is capable of safely carrying as large a load.

The design of the present brace system enables the brace 48 to not only act in tension, as would be commonly expected, but to also act in compression to provide stability to the shelving. During assembly, the lower end 50 of brace 46 is first moved laterally into slot 18 in the face 20 of post 12. In this position the upper bent end 54 of the brace is positioned vertically below slot 56 in cross member 36. As brace 46 is moved upwardly to cause the sides of slot 52 to snugly engage the opposite surfaces of face plate 20, as discussed previously, brace upper end 54 is brought into register with slot 56 such that a small lateral force on brace 48, such as a force exerted by the pressure of the assembler's thumb, causes end 54 to snap into slot 56. Since slot 56 is only slightly larger in thickness than the bent end 54 of brace 46, when the shelving is rocked or caused to tilt during loading, a compression force may be borne by brace 46 exerted between the outer side of slot 52 in the lower end of the brace as it bears on the outside of face wall 20 and the outer surface of bent end 54 as it bears on the adjacent edge of cross member slot 56.

It should thus be understood that the pairs of braces 46 associated with each cross member 36 are designed to normally function in tension and the present design provides a unique non-bolted or welded brace which may also function in compression in certain situations.

When it is desired to disassemble shelving system 20, tab 16 can be conveniently straightened with, for instance, a pair of pliers so that brace 46 can be disengaged from cross member 36 and posts 12. Thereafter, the ends of cross members 36 can be lifted upwardly to disengage hooks 48 from face wall 20 and then the hooks can be slidably disengaged from slots 18. The same procedure is used to disassemble longitudinal members 24 from posts 12.

As will be apparent to those skilled in the art to which the invention is addressed, the present invention may be embodied in forms and in embodiments other than that specifically disclosed above, without departing from the spirit or essential characteristics of the invention. The particular embodiment of the shelving system 10 described above, is therefore to be considered in all respects as illustrative and not restrictive, i.e. the scope of the present invention is set forth in the appended claims rather than being limited to the example of the shelving system 10 as set forth in the foregoing description.

I claim:

1. In a frame construction including an upright, first frame member having a face wall and a second frame member having one end portion connected to the first frame member to extend transversely from the face wall, the improvement comprising:

a. a first slot formed in the first frame member face wall at a location spaced from the intersection of the first frame member with the second frame member;

b. a second slot formed in the second frame member at a location spaced from the end portion of the second frame member;

c. a diagonal brace having:

a first end portion extendable through the first slot to engage with the first frame member face wall, an elongate intermediate portion, and a second end portion extending transversely to the length of the brace intermediate portion, said second end portion extendable through the second slot; and including a base section and an elongate, relatively narrow locking tab section formed integrally with and nominally disposed coplanar with the base section; and d. said locking tab section;

extending transversely outwardly from the base section in a direction generally along the length of the second frame member;

including a generally straight edge portion spaced away from the adjacent side face of the brace intermediate portion to form a clearance gap therebetween to receive portions of the second frame member; and being bendable relative to the second end portion base section to a location skewed from the plane of the base section to dispose the tab section edge portion over the adjacent face of the second frame member to securely lock the second frame member between the locking tab edge portion and the brace intermediate portion.

2. The improvement according to claim 1, wherein the gap defined by the locking tab section edge portion and the brace intermediate portion varies in width along the length of the tab edge portion, with the width of the gap adjacent the intersection of the tab and base being slightly narrower than the thickness of the second frame member thereby to tightly clamp the second frame member therebetween when the tab section is bent into locking position.

3. A shelving system comprising:

a tubular post having a face wall and a vertically elongate first slot formed in the face wall;

a horizontal frame cross-member engageable with the post at an elevation above the first slot to extend transversely outwardly from the post, the cross-member having a second slot formed therein at a location spaced from the post; and a brace including:

a hooked lower end portion extendable through the first slot to engage with the upper edge portion of the first slot, an elongate intermediate portion extending diagonally upwardly and outwardly from the first slot to overlie portions of the cross-member, and an upper end portion extending transversely to the brace intermediate portion, and extendable through the second slot, said upper end portion having a locking tab integrally formed with and disposed nominally coplanar with the brace upper end portion, the tab extending transversely relative to the length of the brace upper end portion in a direction generally parallel to the length of the second slot to form a clearance gap between the brace intermediate portion and the locking tab whereby after insertion of the brace second end portion into the second cross-member slot, the locking tab is bendable relative to the brace second end member to securely retain the cross-member between the brace intermediate member and the locking tab.

4. The shelving system according to claim 3, wherein the second slot is located intermediate the margins of the cross member so that the brace intermediate portion overlaps portions of the cross member.

5. The shelving system according to claim 4, wherein the clearance gap progressively increases in width along the length of the locking tab, with the width of the gap at the intersection of the locking tab and brace upper end portion being narrower than the thickness of the cross-member so the cross-member is tightly clamped between the brace intermediate portion and the locking tab.

* * * * *